US007584939B2

(12) United States Patent
Stiehl et al.

(10) Patent No.: US 7,584,939 B2
(45) Date of Patent: Sep. 8, 2009

(54) SURGE FLUSHING DEVICE FOR WASTEWATER CHANNELS AND THE LIKE

(75) Inventors: Oliver Stiehl, Wiesbaden (DE); Jörg Michael Steinhardt, Taunusstein (DE)

(73) Assignee: Steinhardt GmbH, Taunusstein (DE)

( * ) Notice: Subject to any disclaimer, the term of this patent is extended or adjusted under 35 U.S.C. 154(b) by 239 days.

(21) Appl. No.: 11/296,308

(22) Filed: Dec. 7, 2005

(65) Prior Publication Data

US 2006/0144444 A1 Jul. 6, 2006

(51) Int. Cl.
*F16K 31/18* (2006.01)

(52) U.S. Cl. ..... 251/326; 137/423; 137/445

(58) Field of Classification Search ..... 137/440, 137/445, 423; 251/326, 328, 279, 301, 193, 251/334; 277/504, 505, 578, 929
See application file for complete search history.

(56) References Cited

U.S. PATENT DOCUMENTS

| | | | | | |
|---|---|---|---|---|---|
| 1,732,319 | A | * | 10/1929 | Wagner | 137/115.02 |
| 2,759,697 | A | * | 8/1956 | Harza et al. | 251/25 |
| 2,786,542 | A | * | 3/1957 | Orfel et al. | 137/445 |
| 2,844,163 | A | * | 7/1958 | Steinberg | 137/423 |
| 3,043,555 | A | * | 7/1962 | Breher | 251/187 |
| 4,502,702 | A | * | 3/1985 | Nixon, Jr. | 277/545 |
| 4,524,950 | A | * | 6/1985 | Vitas et al. | 251/326 |
| 4,676,268 | A | * | 6/1987 | Sano | 137/375 |

FOREIGN PATENT DOCUMENTS

| | | | |
|---|---|---|---|
| CH | 306934 | | 7/1955 |
| DE | 1128816 | | 4/1962 |
| DE | 1133317 | | 7/1962 |
| DE | 1200755 | | 9/1965 |
| DE | 3510171 | A1 | 10/1986 |
| DE | 10320308 | B3 | 6/2004 |
| GB | 1050144 | | 12/1966 |
| JP | 60-192167 | A | 9/1985 |
| WO | WO 02/076862 | A1 | 10/2002 |

* cited by examiner

*Primary Examiner*—John Rivell
*Assistant Examiner*—Craig M Schneider
(74) *Attorney, Agent, or Firm*—Price, Heneveld, Cooper, DeWitt & Litton, LLP

(57) ABSTRACT

A surge flushing device for wastewater systems and the like includes a wastewater channel having an arc-shaped wall portion, as well as a flushing blade element having a marginal portion thereof shaped to selectively mate with the wall portion of the channel, and mounted for shifting in a direction generally perpendicular to the direction of flow in the channel between a lowered, closed position, and a raised, open position. A gasket has a base portion supported on the marginal portion of the blade element and an elastically deformable lip portion which protrudes radially outwardly therefrom, and abuttingly engages the wall portion of the channel when the blade element is in the lowered, closed position, in an elastically deformable curved shape which opens outwardly in a direction opposite to the direction of flow in the channel to selectively form a secure seal therebetween.

15 Claims, 4 Drawing Sheets

SURGE FLUSHING DEVICE FOR WASTEWATER CHANNELS AND THE LIKE

CLAIM OF PRIORITY

Applicants hereby claim the priority benefits under the provisions of 35 U.S.C. § 119, basing said claim of priority on European Patent Application Serial No. 04 029 029.8, filed Dec. 8, 2004. In accordance with the provisions of 35 U.S.C. § 119 and Rule 55(b), a certified copy of the above-listed European patent application will be filed before grant of a patent.

BACKGROUND OF THE INVENTION

The present invention relates to a flushing device for a channel, and especially to a surge flushing device for a wastewater channel with a flushing blade that can be moved essentially perpendicular to the flow direction of the liquid in the channel, between a lowered position, in which the flushing blade contacts an arc-shaped wall area of the channel wall and related channel cross section, and a raised position, in which the flushing blade releases or opens at least one part of the channel cross section.

A surge flushing device for a wastewater channel of the type described above is known from EP 1 219 753 A2. In it, a flushing blade is used that can swivel, is mounted so that it is sealed with respect to the channel wall, is automatically controlled, and is designed with a plate shape. In a mostly empty channel, even with low wastewater flow, this creates banking and allows it to proceed as a flushing surge. The flushing blade is guided to and in the channel by a lever mechanism. A closure is provided that holds the flushing blade in the lowered position and that is unlocked by a mechanism controlled from the head water to release the flushing blade.

A surge flushing device for a wastewater channel of the type described above is also known from EP 1 475 484 A2. In that case, a further development of the surge flushing device according to the EP 1 219 753 A2 document is described. It is distinguished in that a lift element works together with the lever arms of a parallel lever, connected in force and movement, for actuating the flushing flap/flushing blade. In the flushing operation, the flushing flap is driven out over the water level in the channel by the lift element. Because of this, the skimming wall effect on the flushing flap is eliminated, and the floating substances that are carried along on the water surface in the wastewater flow can pass the flushing flap unimpeded.

SUMMARY OF THE INVENTION

The present invention contemplates providing a flushing blade or flushing flap that is formed in such a way that sealing is caused with respect to the channel base and to the lateral channel walls. In this case, an absolute seal is not absolutely necessary. It is adequate if the gasket is designed in such a way that a defined backwater occurs in front of the flushing flap as a result of the inflow. It is also conceivable to provide the waterway of the channel in the area of the flushing flap with a stop for the gasket, against which the flushing flap contacts and/or which acts as a seal along its contour in the lowered position.

Another objective of the invention is to further develop a flushing device of the type described above in such a way that a sealed closure between the flushing blade and the channel wall is ensured in all backwater operating positions or conditions of the banking blade, especially with a high banking of liquid in the channel.

Yet another objective of the invention is a flushing device of the type described above, wherein the flushing blade has an elastic gasket in its area that comes in contact with the channel wall, whereby the gasket has a base section held in a flushing blade element of the flushing blade and a lip section located outside the flushing blade element to contact the channel wall, whereby the lip section is pointed opposite the flow direction of the liquid, starting from the base section.

In regards to the present invention, the designated channel wall is understood not only as the sidewall area of the channel wall, but also the floor area of the channel wall.

The flushing device according to the present invention ensures a high degree of sealing between the flushing blade and channel wall. This is the basic prerequisite for banking adequate liquid in the channel in front of the flushing blade to initiate the subsequent flushing process, especially the surge flushing process. The latter requires a fast raising of the flushing blade and thus a sudden release of the water quantities that are banked or collected in front of the flushing blade. The water quantities held back by the flushing blade cause a considerable force to act on the flushing blade. This necessarily has the consequence that the position of the flushing blade changes slightly relative to the channel wall when the flushing blade is actually positioned in the floor area of the channel walls, but is slightly pushed by the liquid masses in its upper end area. It is equally conceivable that the flushing blade is shifted or moved slightly away from the channel wall to the floor area. However, this must not lead to the formation of a gap or slot between the flushing blade and the channel wall, especially a slot that increases continuously as a function of the water pressure. This would result in a situation where the liquid would flow out between the flushing blade and channel wall without the desired flushing effect.

In view of these factors, the design according to the present invention provides a flushing blade with a gasket in which the lip section contacts the channel wall with a pre-stress that increases with higher pressure in the liquid, such that the lip section is pressed against the channel wall with higher pressure. The pressure acts on the lip section, which extends in a direction opposite the flow direction of the liquid, starting from the base section of the gasket. With the elastic gasket, the base section thus serves as the mounting for the gasket in the flushing blade element, while the lip section takes over the actual sealing function.

It is considered especially advantageous if the flushing blade is designed with a plate shape, while in the area of the face side of the flushing blade, it has a holder for the base section. Naturally the flushing blade could also have a shape other than a plate shape, e.g., as a hollow body, in order to utilize the uplift of the flushing blade when the flushing blade is raised. It is important for the present invention that the gasket provided for contact with the channel wall is continuously active in the area of the flushing blade.

It is considered especially advantageous if the flushing blade is designed in such a way that it has an arc shape, and especially a semicircular shape, in its area that acts together with the channel wall. The upper end of the flushing blade thus has an essentially horizontal edge that extends downward from the semicircular contour of the flushing blade. As a consequence, a flushing blade designed in this way acts together with a channel that has a cross section with a semicircular shape.

In construction, the flushing device is especially designed in such a way that the channel wall that can be brought into active connection with the flushing blade is a component of a metal wall that is formed by a channel insert part, which consists of stainless steel. In this way, the gasket works together with a metal wall area of the channel. Because of this, a smooth surface of the wall part is ensured and thus a favorable prerequisite for a good seal between the flushing plate and channel wall.

According to a special embodiment of the invention, it is provided that the sidewall areas of the channel wall that can be brought into active connection with the flushing blade are slightly convergent or tapered to the floor area of the channel walls. The effect achieved here is that the flushing blade is largely lowered into the channel without the gasket of the flushing blade contacting the channel wall. Just before the flushing blade reaches the completely lowered position, it contacts the sidewall areas because the sidewall areas of the channel walls are arranged so that they are slightly convergent or tapered. Because of this feature, the force is significantly reduced during lowering and lifting of the flushing blade, and the elastic gasket is not stressed. The flushing blade performs or exercises its sealing function only shortly before it reaches the completely lowered position and in the completely lowered position of the flushing blade.

Since the flushing device according to the present invention depends on precise arrangement of the gasket with respect to the channel wall, it is suggested that the gasket be mounted in the flushing blade element so that it can be adjusted. It is especially understood that an adjusting capability of the gasket exists in a radial direction with an arc-shaped or circular-shaped design of the flushing blade.

The gasket is distinguished by a defined Shore hardness, whereby this is especially true for the lip section. It is considered advantageous if the Shore hardness of the gasket is 40 to 70. The sealing lip is provided with a Shore hardness in the named low range if a relatively small diameter of the channel wall has to be closed by the flushing blade. With an average diameter of the channel wall, preferably a Shore hardness of 60 is used, and with a large diameter, a Shore hardness of 70 is used. Apart from this, the Shore hardness of the gasket should be lower with lower water pressure than with higher liquid pressure that has to be managed.

According to a special characteristic of the present invention, it is provided that the elastic gasket is designed so that it is straight before installation in the flushing blade element, and the elastic gasket is pulled into a curve during installation on the flushing blade element. In this way, the elastic gasket can be manufactured very easily as a straight, elongate construction element, the gasket cross section of which is formed by the base section and the lip section. The gasket is not deformed to a curve until it is mounted on the flushing blade element and is stronger toward the inside, with higher stiffness, which means that with the lip section, it is pointed more strongly opposite the flow direction of the liquid.

The geometric dimensions of the flushing blade with the gasket are to be adapted according to the channel wall. In particular, it is conceived that, in the lowered position of the flushing blade, the sealing lip with its curved outer lip section extends in a direction opposite the flow direction and is prestressed relative to its initial straight forward shape. The diameter of the base section of the gasket may be less than the diameter of the channel wall, and the diameter of the lip section may be greater than the diameter of the channel wall.

Basically, the gasket could also be designed in such a way that, starting from the base section, it has another lip section extending in the flow direction behind the lip section. This can extend exactly radially or also diagonally, seen in flow direction of the liquid. In this case, the sealing of the gasket would occur not only in the area of the lip section opposite the flow direction of the liquid, but also over the latter lip section(s). However, this is the lip section that extends opposite the flow direction of the liquid. Only this causes the advantageous consequences because of the effect of the water pressure.

Further characteristics of the invention are explained in the sub-claims, the description of the figures and the figures themselves, whereby it should be noted that all individual characteristics and all combinations of individual characteristics represent other designs according to the invention.

BRIEF DESCRIPTION OF THE DRAWINGS

One embodiment will be described in more detail in the following, with reference to the drawings. They show.

DETAILED DESCRIPTION OF THE PREFERRED EMBODIMENTS

Figure 1:
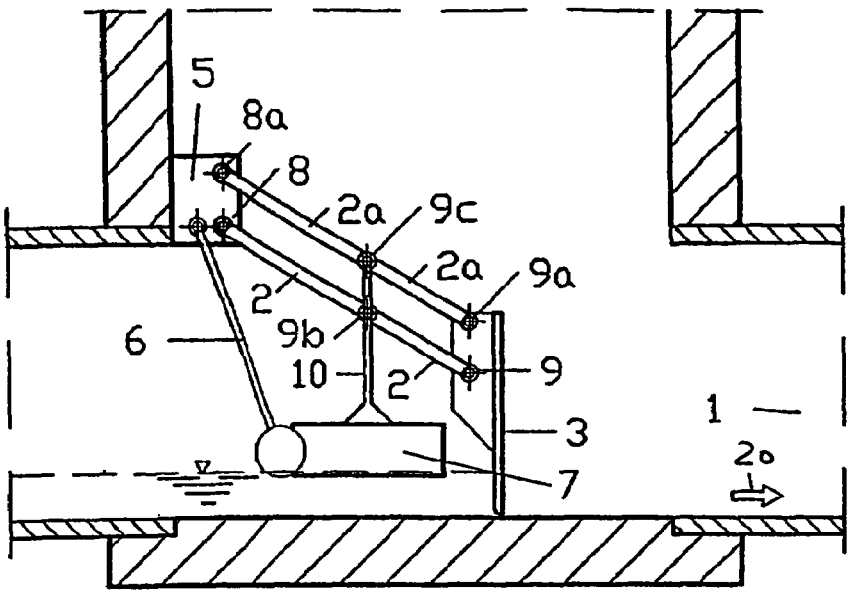
FIG. 1 shows a cross section through the device, in longitudinal direction of the channel in the lowered position of the flushing blade.
Figure 2:
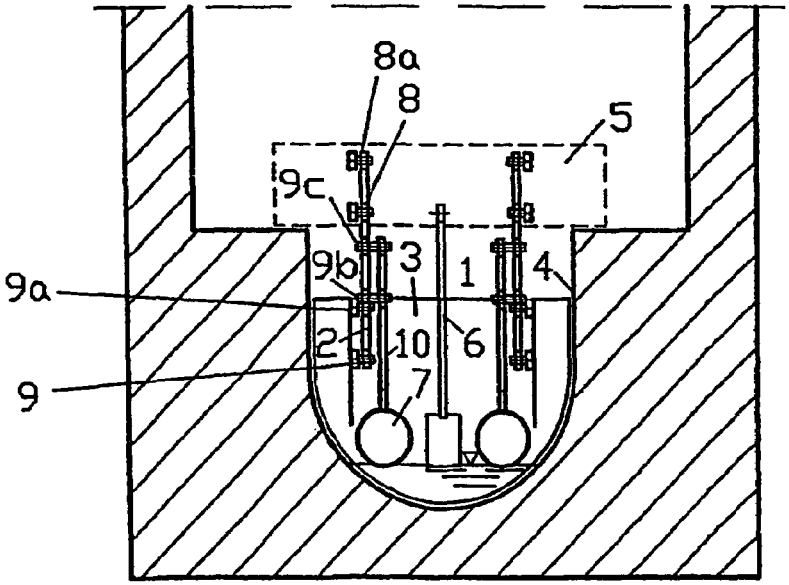
FIG. 2 shows a view of the device according to FIG. 1, on the head water side, perpendicular to the channel profile, seen in flow direction.
Figure 3:
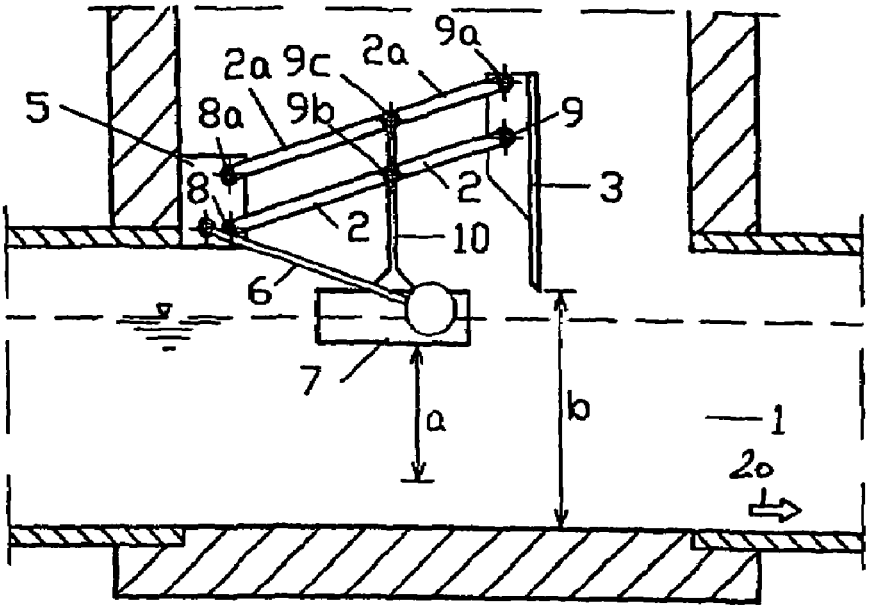
FIG. 3 shows a cross section through the device, in longitudinal direction of the channel with the flushing blade released, in suspended state.
Figure 4:
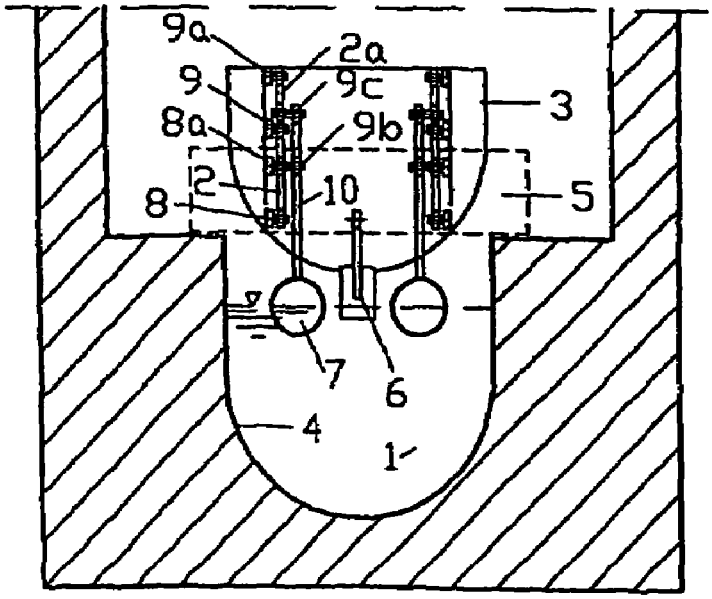
FIG. 4 shows a view of the device according to FIG. 3, on the head water side, perpendicular to the channel profile, seen in flow direction.

For purposes of description herein, the terms "upper", "lower", "right", "left", "rear", "front", "vertical", "horizontal" and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

FIGS. 1 to 4 show a wastewater channel 1 with a flushing blade assembly 3, which can also be designated as a flushing flap, guided to and in the channel by lever arms 2 and 2*a* of a parallel lever. The flushing blade assembly 3 is mounted sealed against channel wall 4. In the lowered position of flushing blade assembly 3, it is held tight by a closure 5 (not shown in more detail here) so that the incoming wastewater (dry weather inlet) can back up or collect in front of the flushing shield or blade assembly 3. When a defined back up water level is reached, the flushing blade assembly 3 is actuated from the head water level to release the flushing surge by way of a control mechanism 6 that is not shown in more detail. In front of flushing blade assembly 3, a lift element 7 is mounted, which is designed, e.g., as two pipe parts lying parallel to each other, whereby the control mechanism operated by the float moves between the pipe parts.

The flushing blade assembly 3 is connected by way of the rotary bearings 9 and 9*a* defining a hinge mounting to lever arms 2 and 2*a,* which can be swiveled on the fixed rotary bearings 8 and 8*a*. On the lever arms 2 and 2*a,* the rotary bearings 9*b* and 9*c* are fastened parallel to the rotary bearings 8, 8*a* and parallel to the rotary bearings 9, 9*a*. On the rotary bearings 9*b* and 9*c,* a vertically oriented operating rod 10 is mounted, which at its lower end holds a float or lift element 7 that is tightly connected to operating rod 10. However, the lift element 7 can also be designed so that it is elongated toward the top, incorporating operating rod 10 integrally therein to operate directly by way of rotary bearings 9*b,* 9*c* with lever arms 2, 2*a*.

In the illustrated embodiment, the rotary bearings 9, 9*a,* 9*b* and 9*c,* and the rotary bearings 8, 8*a,* 9*b* and 9*c* form a shifting rhomboidal force parallelogram, or side-by-side, four bar linkages.

FIGS. 5 to 8 show the structure of the elastically deformable gasket 11 forming a component of the flushing blade assembly 3 and its mounting on flushing blade element portion 13 of flushing blade assembly 3, as well as the interaction of gasket 11 and channel wall 4.

Figure 5:
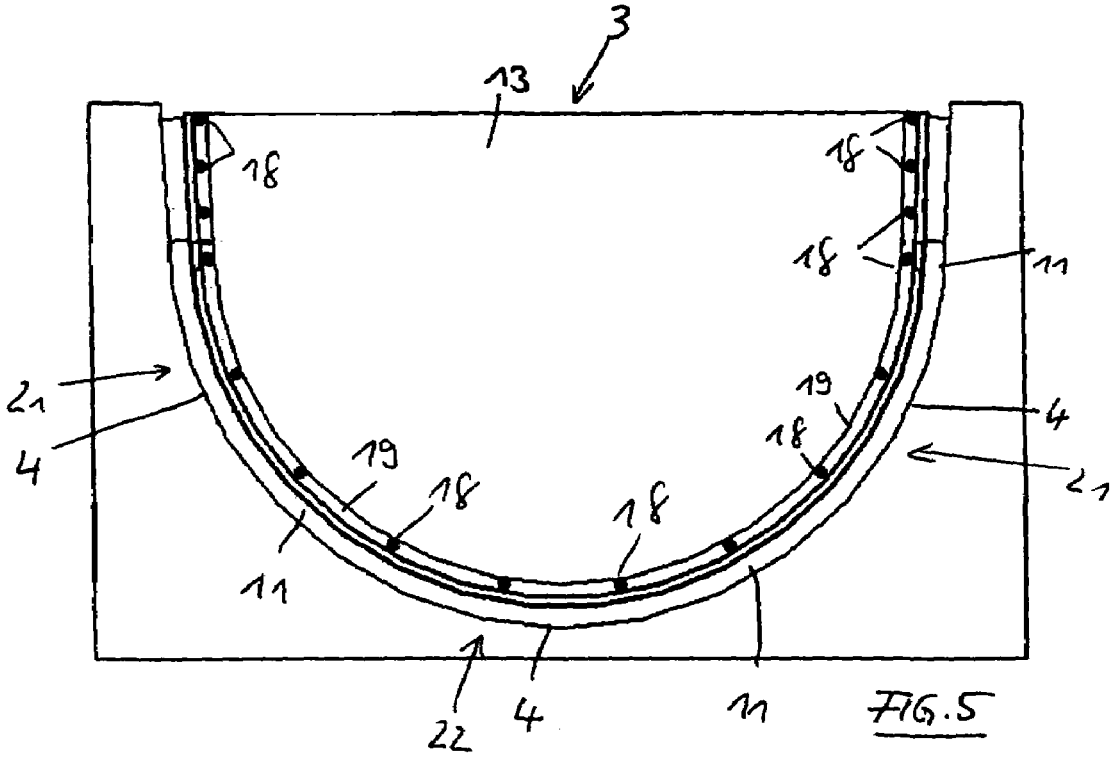
FIG. 5 shows an illustration of the channel with the channel wall and flushing blade found in the lowered position.

The flushing blade element 13, which consists of metal, has a semicircular base shape with respect to the channel cross section, and a rectangular section is connected at the top on the semicircular section. The cross section of channel wall 4, as can be seen best in FIG. 5, is designed according to a semicircular design with straight sections connected on top.

The gasket 11 has a base section 14 (FIGS. 7 and 8) held in the flushing blade element 13 and a lip section 15 protruding radially outwardly of the flushing blade element 13. The latter is used for abutting, sealing contact with the channel wall 4. The base section 14 has a thickness that remains uniform along the flow direction 16 of the liquid, and is thus designed in a ring shape. The lip section 15, which narrows conically or tapers starting from base section14, is connected to the base section 14. For example, the lip section 15 encloses an angle $\alpha$ of about 140 degrees with the base section 14. The length of the lip section 15 is, e.g.,approximately four times as large as the length of the base section, related to the radial extension of base section 14. The end of the lip section 15, which is turned away from the base section 14, is designed so that it is blunt with a face surface 16 that runs parallel to the face surface 17 of the base section 14 turned toward the flushing blade element 13, relative to the condition of the gasket 11 before installation on the flushing blade element 13. By means of an adjusting device 18 that has screws connected with the flushing blade element 13, and a pressure plate designed so that it is curved according to the edge contour of the flushing blade element 13, the base section 14 is held in the flushing blade element 13 and can be pointed or oriented radially outwardly in it.

Figure 6:
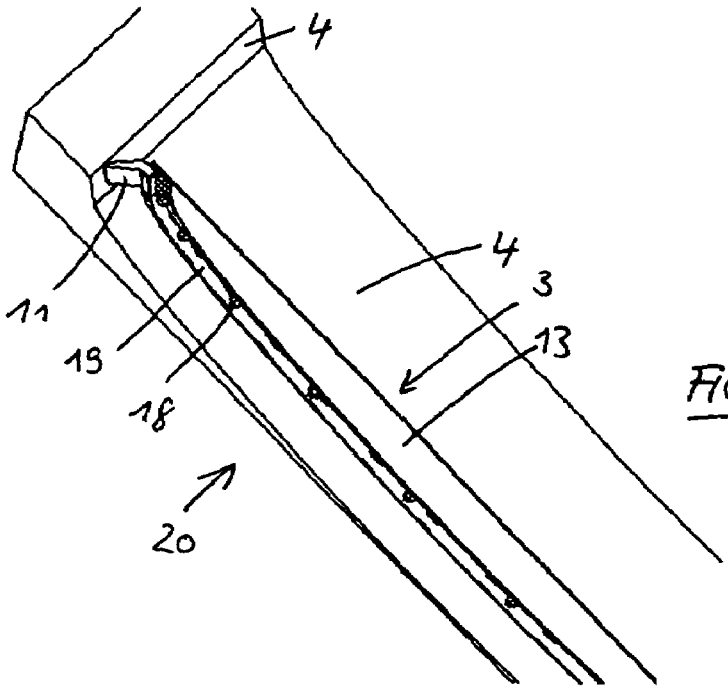
FIG. 6 shows a three-dimensional view of the arrangement according to FIG. 5, seen diagonally from the top.

In order to make the drawing clear, FIG. 6 shows the gasket 11 over only a short length to show its contact with the channel wall 4. The flow direction of the liquid through the channel is indicated by the arrow with reference number 20.

Figure 7:
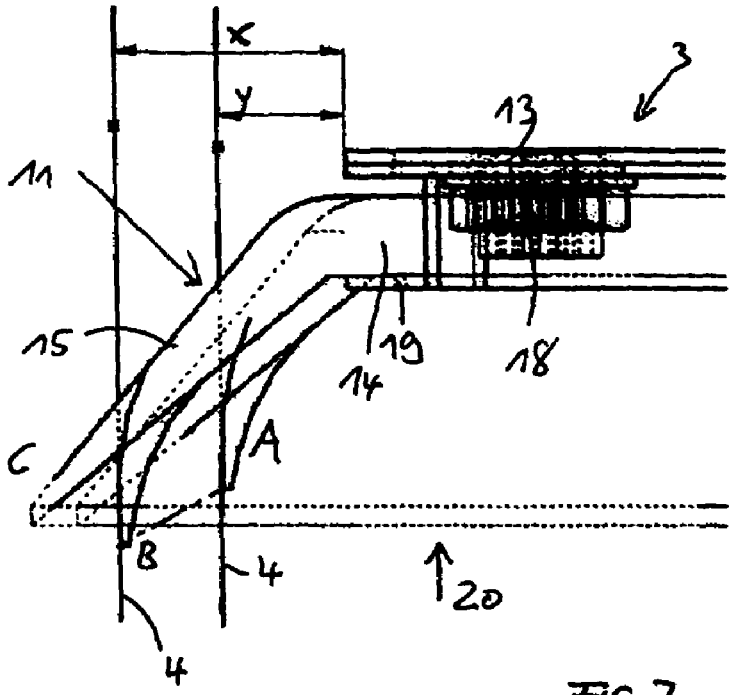
FIG. 7 shows a cross section through the sealing area between the flushing blade and wall, shown for different positions of the lip section of the gasket.
Figure 8:
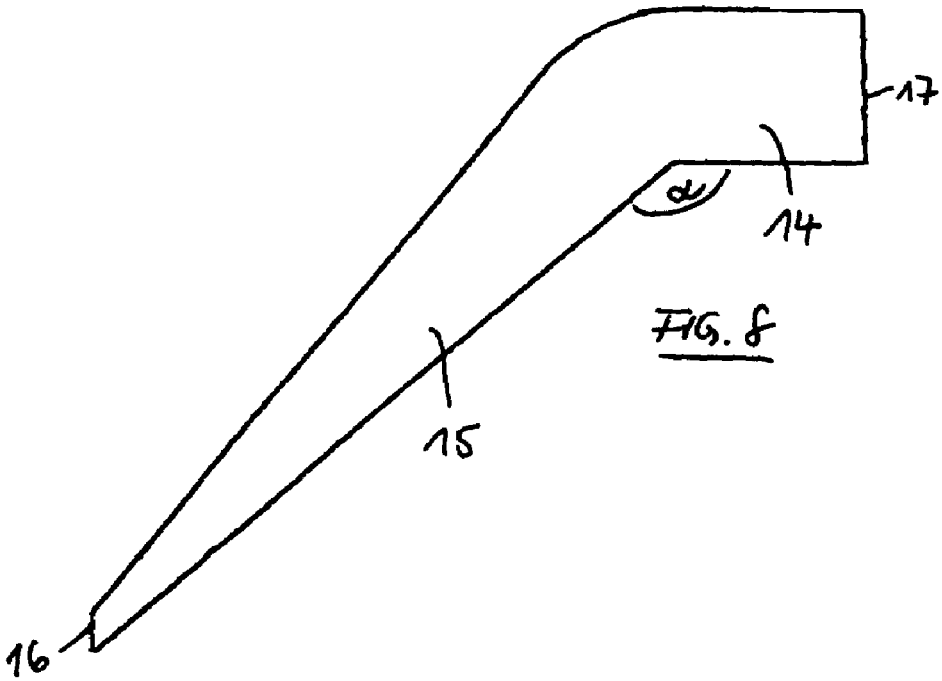
FIG. 8 shows a cross section through the gasket before the gasket is drawn up into a curve.

FIG. 7 shows different bending positions of the lip section 15, and thus the sealing action between gasket 11 and channel wall 4, whereby two positions of the channel wall 4 are shown. With a distance "y" of the flushing blade element 13 from the channel wall 4, the lip section 15 is more curved or arcuate with respect to the base section 14, as shown in position "A". In this position, the distance "y" is, e.g., 20 millimeters. If the distance between the flushing blade element 13 and the channel wall 4 is greater, e.g., according to the dimension "x", less curvature occurs between base section 14 and lip section 15, as shown in position "B". The distance "x" is, e.g., 35 millimeters. If the lip section 15 does not contact the channel wall 4 at all, the relaxed position of the gasket 11, as shown in position "C", occurs, which basically corresponds to the position according to the illustration in FIG. 8.

It is clear, especially from the illustration in FIG. 5, that the illustrated sidewall areas 21 converge or taper outwardly toward the top of channel wall 4. The consequence of this is that, during lowering of the flushing blade 3, the gasket 11 does not contact the channel wall 4 at first, but only contacts it shortly before the lowest position is reached. During further lowering of the flushing blade assembly 3 into the completely lowered position, the position of the lip section 15, as shown as "A", in FIG. 7 is assumed. Because of the elasticity of gasket 11, in this position, it presses with especially high force against channel wall 4 with distance dimension "y". If the flushing blade 3 is raised slightly, especially as a result of the high liquid pressure that is present, this results in the displacement of the flushing blade 3 into the position "B" shown in FIG. 7. Even in this case, a seal between flushing blade 3 and channel wall 4 would be ensured by the gasket 11, and the relatively high water pressure that acts in flow direction 20 presses the lip section 15 against the channel wall 4 with an additional force.

The channel wall 4, which works together with gasket 11, is especially designed of stainless steel. The channel section assigned to this channel wall represents a separate channel insert part.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is as follows:

1. A surge flushing device for wastewater systems, comprising:

a wastewater channel having an arc-shaped wall portion;

a flushing blade element having an arc-shaped marginal portion thereof configured geometrically similar to said wall portion of said channel;

a blade support linkage pivotally connected with said blade element and rotatably suspending said blade element generally above said wall portion of said channel, and configured to pivotally shift said blade element in a direction generally perpendicular to the direction of flow in said channel between a fully lowered, closed position, and a fully raised, open position, such that in said fully lowered, closed position, said marginal portion of said blade element is disposed a spaced apart distance from said wall portion of said channel;

a gasket having a base portion thereof supported along said marginal portion of said blade element, and a flap-shaped, elastically deformable lip portion thereof protruding generally radially outwardly from said base portion and said marginal portion of said blade element when in said fully lowered, closed position; said lip portion having a thickness that tapers outwardly to a free terminal tip area which directly abuts and engages said wall portion of said channel when said blade element is in said fully lowered, closed position, thereby elastically flexing said terminal tip area into a curved shape which opens outwardly in a direction opposite to the direction of flow in said channel and resiliently urging said terminal tip area radially outwardly against said wastewater channel with a predetermined force to selectively form a secure seal therebetween; and an adjustable holder mounted on said marginal portion of said flushing blade element, and detachably retaining said base portion of said gasket therein to permit radial adjustment of said gasket relative to said flushing blade to insure secure sealing contact between said lip portion of said gasket and said wall portion of said channel.

2. A device as set forth in claim 1, wherein:

said wall portion of said channel includes a portion thereof made from metal which contacts said gasket.

3. A device as set forth in claim 2, wherein:

said adjustable holder is configured such that when said flushing blade element is in said fully lowered, closed position, said gasket is radially adjusted to contact said wall portion of said channel with said predetermined force.

4. A device as set forth in claim 2, wherein:

said adjustable holder includes an adjustment device with fasteners connected with said flushing blade element, and a pressure plate configured so that the same is curved according to said marginal portion of said flushing blade element.

5. A device as set forth in claim 4, wherein:

said flushing blade element has a generally semicircular shape which conforms with the arc-shaped wall portion of said channel.

6. A device as set forth in claim 5, wherein:

said channel includes opposite sidewalls which engage mating portions of said flushing blade element in said fully lowered, closed position, and are tapered to converge toward a base area of said channel.

7. A device as set forth in claim 6, wherein:

said lip portion of said gasket has a Shore hardness in the range of 40 to 70.

8. A device as set forth in claim 7, wherein:

said flushing blade element and associated gasket can be lowered slightly into said channel in a direction opposite to the direction of flow in said channel.

9. A device as set forth in claim 8, wherein:

said gasket has a generally linear initial configuration before installation on said flushing blade element, such that said gasket is deformed into a curved configuration during installation on said flushing blade element.

10. A device as set forth in claim 1, wherein:

said adjustable holder is configured such that when said flushing blade element is in the fully lowered position, said gasket contacts said wall portion of said channel in a pre-stressed condition.

11. A device as set forth in claim 1, wherein:

said adjustable holder includes an adjustment device with fasteners connected with said flushing blade element, and a pressure plate configured so that the same is curved according to said marginal portion of said flushing blade element.

12. A device as set forth in claim 1, wherein:

said channel includes opposite sidewalls which engage mating portions of said flushing blade element in said fully lowered, closed position, and are tapered to converge toward a base area of said channel.

13. A device as set forth in claim 1, wherein:

said lip portion of said gasket has a Shore hardness in the range of 40 to 70.

14. A device as set forth in claim 1, wherein:

said flushing blade element and associated gasket can be lowered slightly into said channel in a direction opposite to the direction of flow in said channel.

15. A device as set forth in claim 1, wherein:

said gasket has a generally linear initial configuration before installation on said flushing blade element, such that said gasket is deformed into a curved configuration during installation on said flushing blade element.

* * * * *